US006869250B2

(12) United States Patent
Moyna

(10) Patent No.: US 6,869,250 B2
(45) Date of Patent: Mar. 22, 2005

(54) COMPACTING DEVICE AND A SYSTEM AND A METHOD FOR COMPACTING A MATERIAL

(75) Inventor: John P. Moyna, Elkader, IA (US)

(73) Assignee: C. J. Moyna and Sons Inc., Elkader, IA (US)

( * ) Notice: Subject to any disclaimer, the term of this patent is extended or adjusted under 35 U.S.C. 154(b) by 19 days.

(21) Appl. No.: 10/350,368

(22) Filed: Jan. 23, 2003

(65) Prior Publication Data

US 2004/0146356 A1 Jul. 29, 2004

(51) Int. Cl.[7] ..... E01C 19/23
(52) U.S. Cl. ..... 404/124; 404/122
(58) Field of Search ..... 404/121, 122, 404/123, 124, 125, 126, 127, 128, 131, 132, 133.05

(56) References Cited

U.S. PATENT DOCUMENTS

| | | | | | |
|---|---|---|---|---|---|
| 2,131,947 | A | * | 10/1938 | Gilmore | 404/121 |
| 2,312,471 | A | * | 3/1943 | Low | 404/121 |
| 3,040,638 | A | * | 6/1962 | Atkinson | 404/121 |
| 3,099,191 | A | * | 7/1963 | Averette | 404/121 |
| 3,358,569 | A | * | 12/1967 | Averette | 404/121 |
| 4,723,870 | A | * | 2/1988 | Martinez | 404/121 |
| 4,950,102 | A | * | 8/1990 | Zeitz | 404/121 |

* cited by examiner

*Primary Examiner*—Thomas B. Will
*Assistant Examiner*—Alexandra Pechhold
(74) *Attorney, Agent, or Firm*—Patent & TMS, P.C.

(57) ABSTRACT

A compacting device and a system and a method for compacting a material are provided. The compacting device may have a base and a column which extends from the base. A sleeve may be fitted and secured around the column. The sleeve may have a length which is greater than a length of the column. Material may be collected within the sleeve and may be used for compaction.

8 Claims, 3 Drawing Sheets

COMPACTING DEVICE AND A SYSTEM AND A METHOD FOR COMPACTING A MATERIAL

BACKGROUND OF THE INVENTION

The present invention generally relates to a compacting device and a system and a method for compacting a material. The compacting device may have a base which may have a column extending from the base. A sleeve is fitted around the column and extends lengthwise from the column. Material to be compacted may collect within the sleeve and may be used to compact other material in an area to be compacted. Use of the material within the sleeve may decrease an amount of contact between the compacting device and the area to be compacted. Accordingly, the compacting device may prevent the sleeve, base and/or column from becoming damaged during compaction.

Of course, road construction of new roads and existing roads is required throughout the country and around the world to expedite travel for trucks, automobiles and the like. An area along the road must be readied to create a surface that is suitable for paving. If the area to be paved has soil, the area is generally prepared for receiving, for example, concrete or other materials. Accordingly, the soil may be broken and may then be pressed, or compacted, to level the soil for receiving the concrete or other materials. Similar soil treatment or preparation is required for construction of buildings, houses, or the like. Prior to construction, an area upon which a building is to be constructed is prepared. The area may be broken and then compacted to prepare the area for receiving, for example, concrete or other materials.

Compaction of soil is typically performed with a roller pulled behind, for example, a tractor. A known roller has a cylindrical body and teeth extending from the body. The teeth are welded to a surface of the roller. Each tooth extends from the body, and the teeth are spaced around a periphery of the roller. As the roller is moved across an area of soil to be compacted, the teeth of the roller may press into the soil to cause compaction of the soil.

The soil often has many rocks, stones, sand, lumps of clay and other like foreign objects mixed with the soil. As a result, repeated contact between a tooth and the area being compacted causes the tooth to become misshaped, broken, chipped, or otherwise damaged. Further, the tooth often experiences rust or like deterioration. If a damaged or broken tooth is left on the roller, compaction of the soil becomes inconsistent and/or less efficient. To repair the roller of broken teeth, each tooth must be removed from the roller, and a new tooth must be welded onto the roller. Accordingly, replacement of the tooth, or multiple teeth, becomes a tedious and labor-intensive task. Further, frequent replacement of a tooth increases costs associated with compacting and/or equipment used to perform compaction.

A need, therefore, exists for a compacting device and a system and a method for compacting a material wherein the compacting device may be less prone to deterioration than known compacting devices.

SUMMARY OF THE INVENTION

The present invention provides a compacting device and a system and a method for compacting a material, such as, for example, soil, stone, sand, or the like. The compacting device may have a body having a base. A column may extend from a surface of the base. A sleeve may be fitted around the column and may have a length greater than a length of the column. As a result, a space may be created within the sleeve into which the material may be collected. The compacting device may then use the collected material to perform the compaction.

To this end, in an embodiment of the present invention, a compacting device is provided. The compacting device has a base having a length defined between a bottom surface and a top surface. The compacting device also has a column having a perimeter and a length defined between a first end and a second end wherein the first end of the column contacts the top surface of the base. In addition, the compacting device has a sleeve having a perimeter and a length defined between a first end and a second end wherein the first end of the sleeve covers the column forming a space within the sleeve extending from the second end of the column to the second end of the sleeve.

In an embodiment, the bottom surface of the base is larger than the top surface of the base.

In an embodiment, the sleeve and the column are integrally formed.

In an embodiment, the length of the sleeve is greater than the length of the column.

In an embodiment, the base and the column are integrally formed.

In an embodiment, the perimeter of the sleeve is less than the perimeter of the column.

In an embodiment, the length of the base is greater then the length of the column.

In an embodiment, the perimeter of the column tapers between the first end and the second end.

In another embodiment of the present invention, a system is provided for compacting a material. The system has a compacting device having a base having a length defined between a bottom surface and a top surface and further having a column having a length defined between a first end and a second end wherein the column extends from the top surface of the base and further wherein the compacting device has a sleeve extending from the first end of the column forming a space within the sleeve. The system also has a roller having a surface wherein the compacting device is attached to the surface of the roller.

In an embodiment, the system has a frame attached to the roller.

In an embodiment, the bottom surface of the base is attached to the surface of the roller.

In an embodiment, the system has an axle extending through the roller.

In an embodiment, the roller is cylindrical in shape.

In an embodiment, the sleeve covers the column.

In an embodiment, the roller and the compacting device are integrally formed.

In another embodiment of the present invention, a method is provided for compacting a material. The method comprises the steps of: providing a compacting device having a base and a column defined between a first end and a second end wherein the column extends from the base and further wherein the compacting device has a sleeve around the column wherein the sleeve is secured around the column forming a space within the sleeve to receive the material; attaching the compacting device to a roller; and moving the roller across the material.

In an embodiment, the method comprises the step of collecting the material within the space.

In an embodiment, the method comprises the step of compacting a material with the material received within the space.

In an embodiment, the base of the compacting device is attached to the roller.

In an embodiment, the method comprises the step of detaching the compacting device from the roller.

It is, therefore, an advantage of the present invention to provide a compacting device and a system and a method for compacting a material.

Another advantage of the present invention is to provide a compacting device and a system and a method for compacting a material which enables compaction of an area prior to pavement of a road, a pathway, or the like.

Yet another advantage of the present invention is to provide a compacting device and a system and a method for compacting a material which enables compaction of an area prior to construction of a building, a home, or the like.

Yet another advantage of the present invention is to provide a compacting device and a system and a method for compacting a material which enables the compacting device to withstand deterioration of the compacting device.

Still another advantage of the present invention is to provide a compacting device and a system and a method for compacting a material which enables the compacting device to be less prone to becoming misshapen during compaction.

A further advantage of the present invention is to provide a compacting device and a system and a method for compacting a material which has a tooth attached to a roller wherein the tooth may be replaced by a second tooth.

Yet another advantage of the present invention is to provide a compacting device and a system and a method for compacting a material which is simple to manufacture.

A still further advantage of the present invention is to provide a compacting device and a system and a method for compacting a material which reduces costs associated with compaction.

Moreover, an advantage of the present invention is to provide a compacting device and a system and a method for compacting a material which reduces an amount of time associated with compaction.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally relates to a compacting device and a system and a method for compacting a material, such as, for example, soil, stone, sand, or the like. The compacting device may use a portion of the material to compact other material. The compacting device has a base and a column, or "tooth," extending from the base. A sleeve having a length greater than a length of the column may be fitted over the column. The material to be compacted may be collected within a space in the sleeve where the sleeve extends beyond the column. The collected material may be used for compaction and may reduce an amount of contact between the column and the material to be compacted. Accordingly, the compacting device may be used for a longer duration than known compacting devices.

Figure 1:
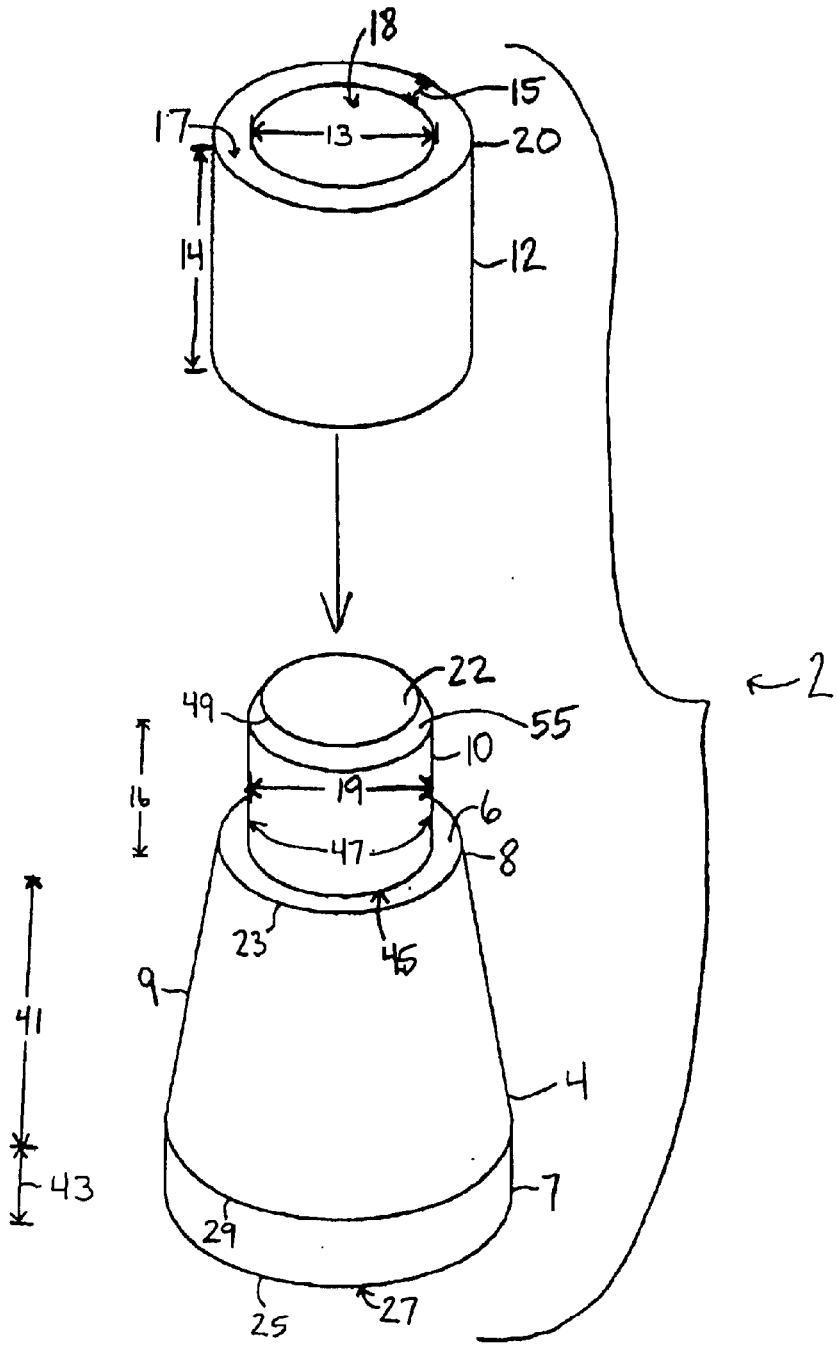
FIG. 1 illustrates an exploded view of a compacting device in an embodiment of the present invention.

Referring now to the drawings wherein like numerals refer to like parts, FIG. 1 illustrates a compacting device 2 in an embodiment of the present invention. The compacting device 2 may have a base 4 having a lower portion 7 and an upper portion 9. The lower portion 7 and the upper portion 9 may be constructed from a metal, such as, for example, steel, lead, or the like. Preferably, the lower portion 7 and the upper portion 9 are integrally formed. Moreover, the lower portion 7 preferably has a length 43 which is less than a length 41 of the upper portion 9.

In an embodiment, the lower portion 7 is cylindrically shaped and may have a perimeter 25 and a bottom surface 27. In another embodiment, the lower portion 7 may be shaped rectangularly. The upper portion 9 may be conically shaped and may have a lower perimeter 29 equal to the perimeter 25. The lower perimeter 29 may be greater than an upper perimeter 23 of the upper portion 9 at an end 8. In other embodiments, the upper portion 9 may have a shape, such as, for example, cylindrical, rectangular, or the like.

The compacting device 2 may be attached to a roller 30 (described in further detail below). To this end, the base 4 may be welded to the roller 30 at the bottom surface 27 of the lower portion 7. However, any other method may be used, such as, fastening devices, sealants, or the like. Welding of the base 4 to the roller 30 may prevent the compacting device 2 from being detached from the roller 30 as a result of stress on the compacting device 2 during compaction. In an embodiment, the roller 30 may be integrally formed with compacting devices attached thereto.

The upper portion 9 of the base 4 may have a top surface 6 at the end 8. A column 10 may be attached to the top surface 6. A bottom surface 45 of the column 10 may be, for example, welded to the top surface 6 of the upper portion 9. However, any method of attachment may be used, such as, for example, sealing, or the like. In an embodiment, the base 4 and the column 10 are integrally formed. The column 10 may be constructed from a metal, such as, for example, steel, lead or the like. Preferably, the column 10 has a length 16 which is less than the length 41 of the upper portion 9. A lower perimeter 47 of the column 10 may be less than the upper perimeter 23 of the upper portion 9. In other embodiments, the column 10 may be shaped, for example, rectangularly, conically, or the like.

The column 10 may have a top surface 22 and a diameter 19. The top surface 22 may have a perimeter 49 which may be less than the lower perimeter 47. The column 10 may also have a surface 55 between the perimeter 49 and the lower perimeter 47. The surface 55 may taper from the lower perimeter 47 to the perimeter 49. The taper between the perimeter 49 and the perimeter 47 may enable a sleeve 12 (described in further detail below) to be placed over the column 10.

FIG. 1 also illustrates the sleeve 12 which may be constructed from a metal, such as, for example, steel, lead, or the like. Preferably, the sleeve 12 has a diameter 13 which is less than the diameter 19 of the column 10. The sleeve 12 may have a contact area 17 having a thickness 15.

The sleeve 12 may be secured around the perimeter 47 of the column 10. To this end, in an embodiment, the sleeve 12 may be heated in a hydraulic, an oil, or like substance. When heated, the diameter 13 of the sleeve 12 may expand to a size greater than the diameter 19 of the column 10. The sleeve 12 may then be placed over the column 10. Upon cooling, the diameter 13 of the sleeve 12 may decrease to secure the sleeve 12 to the column 10. Moreover, the sleeve 12 may have an interference fit with the column 10. In an embodiment, the base 4, the column 10 and the sleeve 12 may be integrally formed.

The sleeve 12 has a length 14 which is greater than the length 16 of the column 10. As a result, a space 18 is created within the sleeve 12 extending from an end 20 of the sleeve 12 to the top surface 22 of the column 10 after the sleeve 12 is secured to the column 10. The space 18 may receive material to be compacted during compaction.

Figure 2:
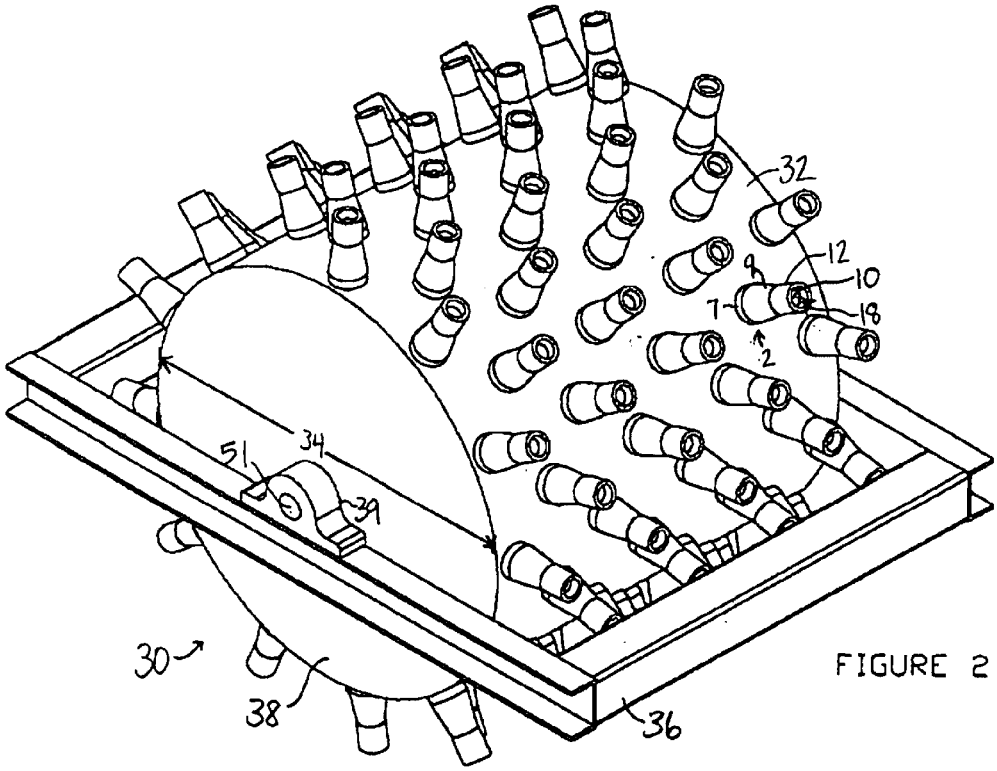
FIG. 2 illustrates a perspective view of a roller which implements the compacting device of FIG. 1 in an embodiment of the present invention.

Referring now to FIG. 2, a roller 30 is illustrated which may have one or more of the compacting devices 2 attached to a surface 32 of the roller 30. Although only one compacting device 2 is labeled in FIG. 2, it should be understood that the compacting devices adjacent to the labeled compacting device 2 have all of the elements described herein with respect to the labeled compacting device 2. The compacting devices 2 may be attached to the surface 32, preferably, by welding. However, other methods for attaching the compacting devices 2 to the roller 30 may also be implemented, such as, for example, sealants, or the like. The roller 30 may have a diameter 34. Preferably, the diameter 34 is between four feet and six feet. The roller 30 may be connected to a frame 36 having a cap 39 which attaches to the roller 30 at a side 38 of the roller 30. The cap 39 may be connected to an axle 51 extending through the roller 30. In use, the roller 30 rotates around the axle 51.

Figure 3:
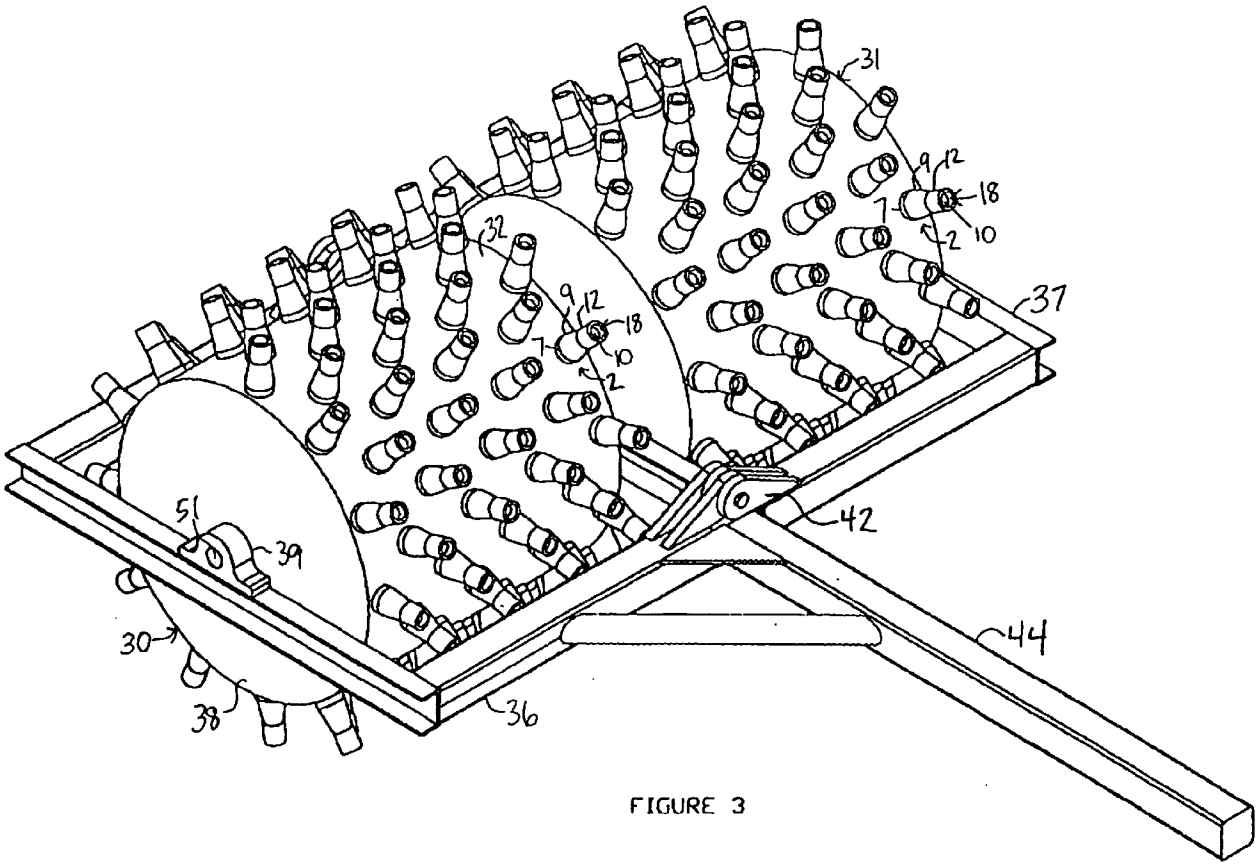
FIG. 3 illustrates a perspective view of a compacting system which implements the compacting device of FIG. 1 in an embodiment of the present invention.

In an embodiment, as illustrated in FIG. 3, a second roller 31 may be used in conjunction with the roller 30 to compact a material. Although only one compacting device 2 is labeled on each of the rollers 30, 31 in FIG. 3, it should be understood that the compacting devices adjacent to the labeled compacting devices 2 have all of the elements described herein with respect to the labeled compacting devices 2. The second roller 31 may be connected to a frame 37. The frame 36 and the frame 37 may be attached by a connector 42. The frames 36, 37 may be attached to a beam 44 which may be connected to, for example, a tractor, a truck, or the like, for moving the rollers 30, 31 across an area to be compacted.

The rollers 30, 31 may be moved across an area of material (not shown) to be compacted for pavement, construction, or the like. As the rollers 30, 31 are moved across the area of material, the sleeve 12 of one or more of the compacting devices 2 is forced against the material to compact the material. The contact area 17 of the sleeve 12 may penetrate the material and cause the material to be collected within the space 18 of the sleeve 12. As the rollers 30, 31 continue across the area to be compacted, the material collected within the sleeve 12 may be used for compaction. Use of a material to perform a compaction is preferable because the material may provide a stronger and/or more durable compacting surface than the compacting device 2 alone may provide.

Following continued use of the roller 30, the sleeve 12 of the compacting device 2 may be broken or otherwise damaged during compaction. The sleeve 12 may then be removed from the column 10. To this end, the compacting device 2 may be heated to cause the sleeve 12 to expand in size. The sleeve 12 may then be removed from the column 10. Other methods of removal may also be used, such as, for example, pulling the sleeve 12 from the column 10. A new sleeve may then be secured to the column 10. The compacting device 2 may be damaged and may require detachment from the roller 30. The compacting device 2 may be removed by heating the bottom surface 27 of the base 4 to loosen a bond formed from welding the base 4 to the roller 30.

By collecting material within the space 18 of the sleeve 12 and using that material for compaction, the compacting device 2 may have a more rigid contact area for contacting materials during compaction of those materials. In addition, use of the compacting device 2 may reduce contact between the column 10 and a material to be compacted. As a result, the column 10 may be used for a longer duration of compaction. In addition, use of the compacting device 2 may enable less frequent replacement of the base 4 and the column 10. Accordingly, the compacting device 2 may reduce an amount of labor associated with replacement of a compacting device on a roller. Less frequent replacement of the compacting device 2 may also reduce overall costs associated with equipment and/or labor used to perform compaction.

It should be understood that various changes and modifications to the presently preferred embodiments described herein will be apparent to those skilled in the art. Such changes and modifications may be made without departing from the spirit and scope of the present invention and without diminishing its attendant advantages.

I claim:

1. A compacting device comprising:

a base having a length defined between a bottom surface and a top surface;

a column having a perimeter and a length defined between a first end and a second end wherein the first end of the column contacts the top surface of the base; and a sleeve having a perimeter and a length defined between a first end and a second end wherein the sleeve has a channel that extends continuously between the first end to the second end wherein the first end and the second end define open ends of the channel and further wherein the channel surrounds the column and further wherein the first end of the sleeve contacts the top surface of the base and wherein the second end of the sleeve extends beyond the second end of the column forming a space within the sleeve extending from the second end of the column to the second end of the sleeve.

2. The compacting device of claim 1 wherein the bottom surface of the base is larger than the top surface of the base.

3. The compacting device of claim 1 wherein the sleeve and the column are integrally formed.

4. The compacting device of claim 1 wherein the length of the sleeve is greater than the length of the column.

5. The compacting device of claim 1 wherein the base and the column are integrally formed.

6. The compacting device of claim 1 wherein the perimeter of the sleeve is less than the perimeter of the column.

7. The compacting device of claim 1 wherein the length of the base is greater then the length of the column.

8. The compacting device of claim 1 wherein the perimeter of the column tapers between the first end and the second end.

* * * * *